US005284039A

United States Patent [19]

Torgerson

[11] Patent Number: 5,284,039

[45] Date of Patent: Feb. 8, 1994

[54] SPACER FOR ROTARY PEENING APPARATUS

[75] Inventor: Donald R. Torgerson, White Bear Lake, Minn.

[73] Assignee: Minnesota Mining and Manufacturing Company, St. Paul, Minn.

[21] Appl. No.: 8,601

[22] Filed: Jan. 25, 1993

[51] Int. Cl.[5] ..... B21J 1/02; B24C 3/00

[52] U.S. Cl. ..... 72/53; 51/332; 51/334

[58] Field of Search ..... 72/53; 29/90.7; 51/332, 51/334, 336, 337

[56] References Cited

U.S. PATENT DOCUMENTS

| | | | |
|---|---|---|---|
| 2,257,06 | 9/1941 | Morris | 51/194 |
| 2,164,800 | 7/1939 | Davis | 51/190 |
| 2,789,401 | 4/1957 | Hargreaves | 51/194 |
| 2,964,887 | 12/1960 | Orozco | 51/194 |
| 2,985,206 | 5/1961 | Letts | 144/208 |
| 3,029,567 | 4/1962 | Gregora | 51/169 |
| 3,191,350 | 6/1965 | Yokel | 51/336 |
| 3,541,740 | 11/1970 | Radik | 51/332 |
| 3,648,498 | 3/1972 | Voss et al. | 72/53 |
| 3,834,200 | 9/1974 | Winter | 72/53 |
| 3,842,547 | 10/1974 | Belanger | 5/334 |
| 3,846,942 | 11/1974 | Belanger | 51/334 |
| 3,857,750 | 12/1974 | Winter et al. | 16/87 |
| 3,879,903 | 4/1975 | Belanger | 51/337 |
| 3,914,908 | 10/1975 | Belanger | 51/334 |
| 4,217,737 | 8/1980 | Hasegawa | 51/334 |
| 4,365,448 | 12/1982 | Wilson | 51/334 |
| 4,441,349 | 4/1984 | Symons | 75/53 |
| 4,821,545 | 4/1989 | Druelle et al. | 72/53 |
| 4,969,299 | 11/1990 | Block | 51/330 |
| 5,016,311 | 5/1991 | Young et al. | 15/88.3 |

FOREIGN PATENT DOCUMENTS

| | | | |
|---|---|---|---|
| 0089566 | 6/1982 | Japan | 51/334 |
| 0142078 | 6/1986 | Japan | 51/334 |
| 0178182 | 8/1986 | Japan | 51/334 |

OTHER PUBLICATIONS

Brochure entitled "Surface Conditioning Application Notes—Mill Scale Removal with 3M Brand Heavy Duty Roto Peen Flap Wheel" from 3M of St. Paul, Minn.; Brochure No. 61-5000-3123-4(85.06)R; 9 pages (double sides).

Flyer entitled "As seen in the Journal of Protective Coatings and Linings—3M Offers a New, Convenient Alternative to Shot Blasting on Concrete" from 3M of St. Paul, Minn.; Brochure No. 61-5000-96-32-8(81.5)R2; 1 page.

Flyer entitled "As seen in the Journal of Protective Coatings and Linings—Power Tool Cleaning Just Got Faster With New, Improved 3M Heavy Duty Roto Peen"; from 3M of St. Paul, Minn.; Brochure No. 61-5000-9621-1(71.5)R1, 1 page.

Flyer entitled "Waste Not!—3M offers the proven cost-effective solution for removing lead paints"; from 3M of St. Paul, Minn.; Brochure No. 61-5000-7374-9(20.0-5)ii; 1 page.

Double—sided sheet entitled "3M Heaby Duty Roto Peen Flap Wheel Assembly Instructions" and 3M Heavy Duty Roto Peen Flap Wheel Instructions from 3M of St. Paul Minn.; Brochure No. 34-7017-9636-8.

Article Reprint entitled "3M Helps Rebuild Fighting Ship"; from 3M of St. Paul, Minn., No. 61-5000-59-40-9(128.05)R1; Sep./Oct. 1983 2 pages (double sides).

(List continued on next page.)

*Primary Examiner*—David Jones

*Attorney, Agent, or Firm*—Gary L. Griswold; Walter N. Kirn; Peter L. Olson

[57] ABSTRACT

The invention relates to a spacer for a rotary peening apparatus having a hub and a plurality of peening flaps that are spaced about and retained by the generally cylindrical peripheral surface of the hub. Each peening flap includes several peening rivets attached to a distal end of the peening flap. The spacer of the present invention positions the peening flaps at at least two locations inward of one of the hub ends of the hub, which enables the rotary peening apparatus to impart a uniform surface finish to a surface.

16 Claims, 5 Drawing Sheets

OTHER PUBLICATIONS

Article Reprint entitled "New SSPC Specification: Power Tool Cleaning To Bare Metal"; Claus; Journal of Protective Coatings and Linings; Oct. 1987; vol. 4, No. 10; 3M of St. Paul, Minn.; Brochure No. 61-50-00-5214-9z(127.5)R1, 3 pages (double sides).

Brochure entitled "Surface Conditioning Application Notes—Sctoch-Brite Products For Surface Preparation Procedure for Repair of Nuclear Grade Coatings on Steel and Concrete"; from 3M of St. Paul, Minn., Brochure No. 61-5000-3086-3(67.05)R1; 4 page (double sides).

Brochure entitled "Surface Conditioning Application Notes—3M Brand Heavy Duty Roto Peen Flap Wheel Coating Removal System" from 3M of St. Paul, Minn., Brochure No. 61-5000-31226(85.06)R; 6 pages (double sides).

Brochure entitled "3M Brand Heavy Duty Roto Peen" (Brochure No. 61-5000-9502-3 (912)ii), 1991.

PRIOT ART

SPACER FOR ROTARY PEENING APPARATUS

TECHNICAL FIELD

The present invention relates to a spacer for a rotary peening apparatus.

BACKGROUND ART

Conventional shot peening or blasting is often used to treat concrete or metal surfaces by blowing or mechanically impelling spherical particles of steel or iron against the surface. For example, new concrete surfaces often must cure for approximately thirty days, after which the top layer of concrete is removed to eliminate latents, residuals, and other undesirable characteristics of the top layer of the concrete. When the top layer is removed, a uniform surface is provided, which allows for more effective application of coatings and the like. Similarly, it is often desirable to remove existing surface coatings, such as paint, prior to the application of a new coating. Shot peening may be used for either of these purposes, because the impact of the individual particles tends to loosen and dislodge particles of concrete and coating.

For metal surfaces, the individual particles produce shallow, rounded overlapping dimples in the surface, stretching the surface radially from each point of impact and causing cold working of the material. The resultant compressive stresses tend to counteract tensile stresses imparted to the workpiece by other processing steps, such as rolling, bending, or abrading. Such blasting or peening operations thus have wide applicability in the field of surface treatment.

Conventional shot peening, although useful for some purposes, has certain disadvantages that tend to limit its usefulness. For example, large and expensive equipment is typically required for collecting, screening, and recirculating the shot particles and impelling them against the surface of the workpiece. Such blasting equipment typically is not portable, and thus may only be used with those workpieces that can be brought to the blasting equipment. Shot peening a workpiece while it is attached to a piece of equipment is very difficult because the particles cannot be easily collected. Shot peening a surface such as a concrete highway is also quite difficult, because the blasting equipment is not highly mobile, and the particles are not easily collected for recirculation.

An alternative to shot peening processes described above is the use of rotary peening devices such as those described in U.S. Pat. Nos. 3,648,498 (Voss et al.), 3,834,200 (Winter), and 3,857,750 (Winter et al.). Rotary peening devices have been used in processes such as the removal of residual stresses in metals, removal of scale and coatings on metal surfaces, removal of coatings on concrete surfaces, and surface preparation of concrete for new coatings. In such rotary peening tools, the peening action is provided by peening rivets attached to peening flaps that are retained by and extend from the perimeter of a hub. As each successive support flap is rotated in proximity to the surface, the peening rivets contact the surface and simulate the peening action of the individual spherical particles of conventional blasting. The rotary peening apparatus is portable, and the peening rivets eliminate the need for collecting and recirculating individual particles.

A rotary peening apparatus 10 according to the prior art is shown in FIG. 1. Apparatus 10 includes a cylindrical hub 12 including hub ends 14 and 16 and opposed hub mounting flanges 18 and 20, only one of which is shown. The hub is adapted for mounting on a shaft or arbor (not shown) for rotation therewith about central axis A—A. Hub 12 includes a plurality of guides 22 that are spaced about the perimeter of hub 12 to provide flap slots 24, which extend parallel to axis A—A and are adapted to receive retaining end 26 of peening flaps 30. Disposed within retaining end 26 is a keeper pin 17, which assists in retaining peening flap 30 within flap slot 24. Several flaps are typically retained in side-by-side relationship within each flap slot, although only one such flap is shown in FIG. 1 for simplicity. Retaining ends 26 of peening flaps 30 are adapted for sliding engagement with flap slots 24, such that the peening flaps may be removed and replaced as desired. For example, a peening flap may become worn or broken, or a different type of peening flap may be required for a particular application, at which time one or more peening flaps may be removed by sliding the peening flaps out of the flap slots 24.

Peening flaps 30 also include a peening end 32, as shown in FIG. 2, which holds one or more peening rivets 34, 36, 38, and 40. Each peening rivet includes a plurality of peening particles 42 protruding therefrom, which particles impact the surface 50 when apparatus 10 is rotated in sufficient proximity to surface 50, as shown in FIG. 1. The peening rivets simulate the individual particles of the blasting processes of the prior art, and may be constructed of, for example tungsten carbide shot. The shot is brazed to a hardened rivet, which is fastened to a flexible flap material to form peening flap 30.

One potential disadvantage of such a rotary peening apparatus occurs if each peening rivet is circumferentially aligned with each successive peening rivet. Because the peening rivets are spaced across the face of the peening flaps, the area of the surface 50 that is between adjacent peening rivets would not be contacted by a peening rivet, and therefore may not be appropriately treated. Such an arrangement can result in a surface having a plurality of ridges and troughs, known as a grooved surface. A grooved surface finish may have certain advantages, such as slip-resistance and water drainage, but for other applications it is more desirable to produce a relatively uniform surface finish. For example, it may be advantageous to provide a uniform surface for receiving paint or other coatings.

In a previous attempt to form a relatively uniform surface, the peening flaps of the rotary peening apparatus have been offset with respect to the peening flaps in adjacent flap slots by one-half of the distance between peening rivets. For example, a hub may include twenty flap slots, and five peening flaps within each flap slot. A spacer ring 60 such as that shown in FIG. 3 includes pin members 62 having a length equal to one-half of the distance between adjacent peening rivets. The pin members 62 are located so as to slide into alternate flap slots 24 around the circumference of hub 12, thereby offsetting alternate rows of flaps with respect to the hub end. Because the length of the pin members is equal to one-half of the distance between peening rivets, each row is offset with respect to each adjacent row of peening flaps. By offsetting alternate rows of peening flaps, the surface finish produced by the rotary peening apparatus is more uniform than would be produced by an apparatus where each peening rivet was circumferentially aligned with each succeeding peening rivet.

Peening apparatuses having alternate rows offset, although an improvement over peening apparatuses wherein each peening rivet is circumferentially aligned with the peening rivet on each adjacent flap, tend to produce a surface having small grooves or streaks in the surface finish. The effect is similar to the case where no spacer is present, because each peening rivet is circumferentially aligned with the corresponding peening rivet on alternate peening flaps around the periphery of the apparatus. Thus, although a spacer for offsetting alternate peening flaps may improve surface finish by ensuring that not all peening rivets are circumferentially aligned, a streaked surface may still result. Such a surface can be undesirable because multiple passes of the peening apparatus may be required to peen the surface adequately. It is therefore desirable to provide a rotary peening device that will produce a relatively uniform surface finish compared to the rotary peening apparatuses of the prior art.

SUMMARY OF THE INVENTION

The present invention includes a spacer ring for a rotary peening apparatus. The apparatus includes a hub having a generally cylindrical peripheral surface, including flap slots for releasably retaining a retaining end of each of a plurality of peening flaps. The peripheral surface is bounded by opposed hub ends. The spacer comprises a base member and a series of circumferentially spaced pin members of at least two different lengths attached to and projecting from said base member. The pin members are adapted for cooperative engagement with the flap slots to position the peening flaps with respect to the hub ends of the hub.

In one embodiment, the base member is circular, and the pin members are arranged about the periphery of the base member. In another embodiment, the pin members include, in order, a plurality of pin members of increasing length, at least one pin member having a maximum length, and a plurality of pin members of decreasing length.

In another aspect of the present invention, a rotary peening apparatus is provided, and comprises a hub adapted for rotation about a central axis. The hub includes a generally cylindrical peripheral surface bounded by opposed hub ends, and flap slots for retaining a retaining end of each of a plurality of peening flaps. A plurality of abrading members are provided, each having peening rivets affixed to a distal end thereof and retaining ends adapted for cooperative engagement with the flap slots to present said peening rivets for contact with a surface. Also included is means for spacing at least one peening flap at a first distance inward of one of the hub ends, and means for spacing at least one other peening flap at a second distance inward of said one of the hub ends, to offset the peening flaps with respect to the one of the hub ends. In one embodiment, the means for spacing comprises a base member and a series of circumferentially spaced pin members attached to and projecting from said base member, said series including at least two pin members of different lengths relative to the base member.

In a broader aspect of the present invention, a spacer is provided for a rotary abrading apparatus having a plurality of abrading members adapted for point abrasive contact with a surface. The spacer includes a plurality of pin members adapted to offset the abrading members with respect to each other to enable the apparatus to impart a desired surface finish to the surface.

Also provided is a method of positioning the peening flaps of a rotary abrading apparatus to enable the apparatus to impart a desired surface finish to a workpiece. The apparatus includes a hub and a generally cylindrical peripheral surface comprising a retainer for retaining an end of each of a plurality of abrading members, the peripheral surface being bounded by opposed hub ends. The method comprises the steps of (a) spacing the abrading members at at least two locations inward of one of the hub ends; and (b) retaining the abrading members in said locations.

DETAILED DESCRIPTION OF THE INVENTION

Figure 1:
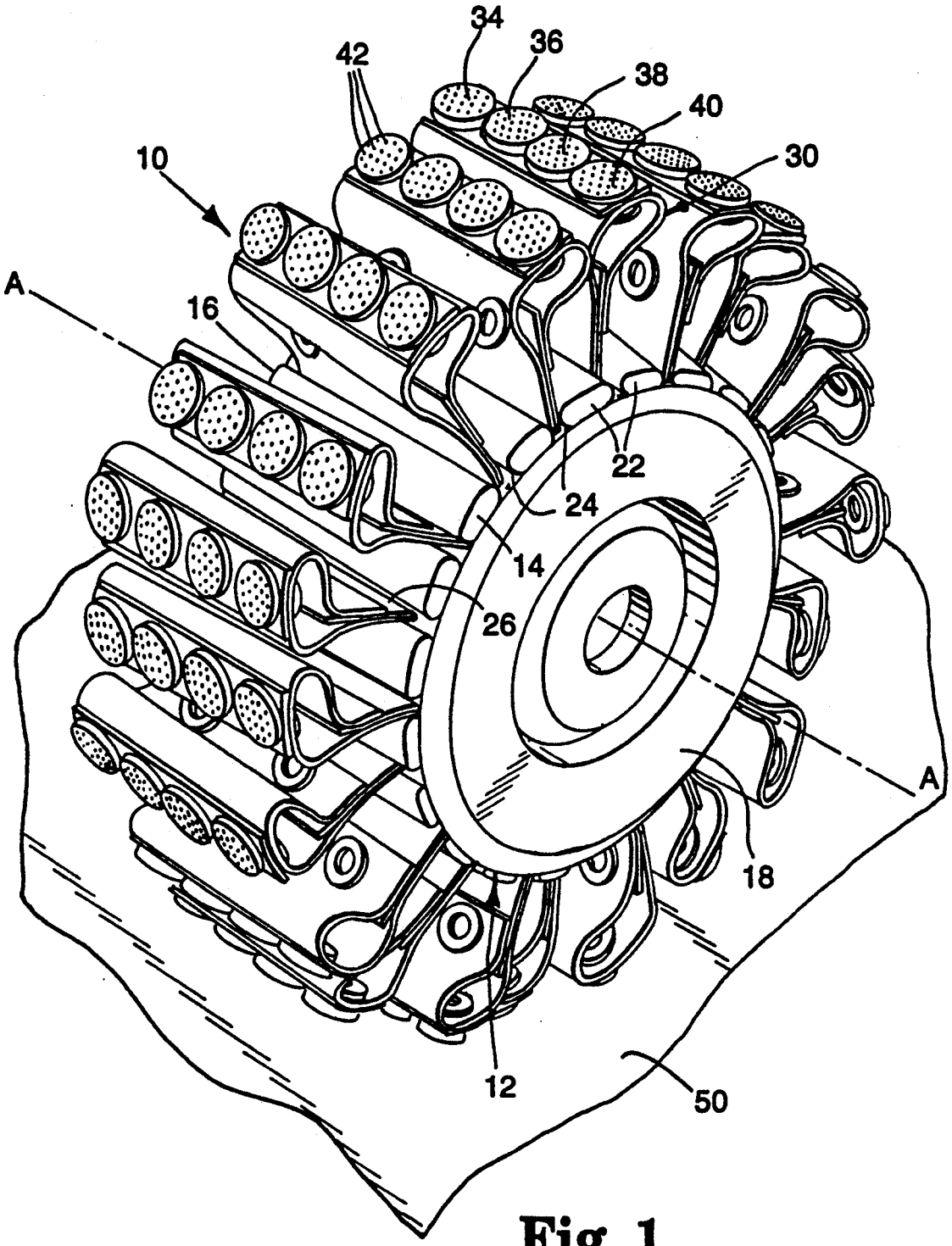
FIG. 1 is a perspective view of a prior art rotary peening apparatus having a plurality of peening flaps adapted for contacting a surface.

The present invention relates to a spacer for positioning the peening flaps of a rotary peening apparatus relative to the hub ends of a hub. The hub 100 of the present invention is as described above with reference to the prior art, and is shown in the context of the present invention in FIG. 4. Hub 100 includes a generally cylindrical peripheral surface bounded by opposed hub ends 102 and 104, only one of which is shown. Also provided are opposed hub mounting flanges 106 and 108, which are adapted to engage hub 100 and to facilitate mounting of hub 100 on a shaft (not shown) for rotation therewith about central axis A—A.

Hub 100 includes means for releasably retaining the retaining end 116 of each of the peening flaps 110. The retaining means is shown in the illustrated embodiment as guides 112 that are perimetrically spaced about the peripheral surface of hub 100 to provide flap slots 114, which extend parallel to axis A—A. Hub 100 may be constructed of, for example, extruded aluminum, and the width of the peripheral face of the peening apparatus is typically greater than the width of the peening flaps 110 that are inserted therein. Retaining ends 116 each include a keeper pin 117, which assist in maintaining the retaining end within flap slots 114. Peening flaps 110 are adapted for sliding engagement with flap slots 114, such that the peening flaps may be removed and replaced as previously described.

Figure 2:
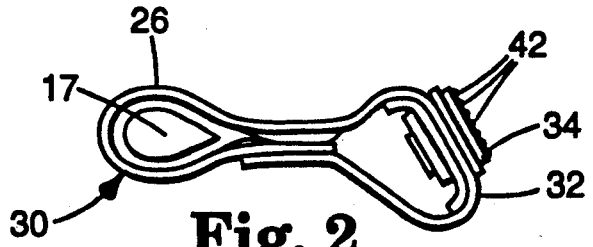
Fig. 2 PRIOR ART
FIG. 2 is a side view of an individual peening flap according to the prior art.

Peening flaps 110 also include a peening end 118, as shown with reference to the prior art in FIG. 2, which peening end typically holds a plurality of peening rivets 120, 122, 124, and 126. The peening rivets are presented by peening flaps 110 for contact with a surface when the apparatus is rotated about axis A—A in sufficient proximity to the surface. The peening rivets include a plurality of protruding peening particles 128 that have been brazed to a hardened rivet to form the peening rivet.

The present invention comprises means for spacing peening flaps 110 inward of hub ends 102 and 104 to enable a rotary peening apparatus to impart a desired surface finish to a workpiece. In general, the spacing means of the present invention must be adapted to offset peening flaps 110 by at least two different positive distances relative to one of the hub ends 102 and 104. Thus, one or more peening flaps may be aligned with hub end 102, but at least one peening flap must be located at a first distance inward of one of said hub ends, and at least one other peening flap must be located at a second distance inward of that same hub end. By locating peening flaps at more than one location inward of the hub end, the rotary peening apparatus tends to impart a relatively uniform finish to the surface compared to the rotary peening apparatuses of the prior art.

The spacing means described above is shown in the illustrated embodiment as a spacer ring 160 having circumferentially spaced pin members 162–192 attached to and projecting from a base member 194 as shown. Spacer ring 160 comprises pin members of at least two different lengths, measured relative to the base member 194, which pin members are adapted to cooperate with the flap slots 114 and with the peening flaps 110 to position the peening flaps with respect to the hub ends 102 and 104 of hub 100. That is, the peening flaps are movable toward the hub ends of hub 100 within the flap slot in which they are retained, and the pin members of the spacer ring position the peening flaps with respect to the hub ends of the hub.

Figure 5:
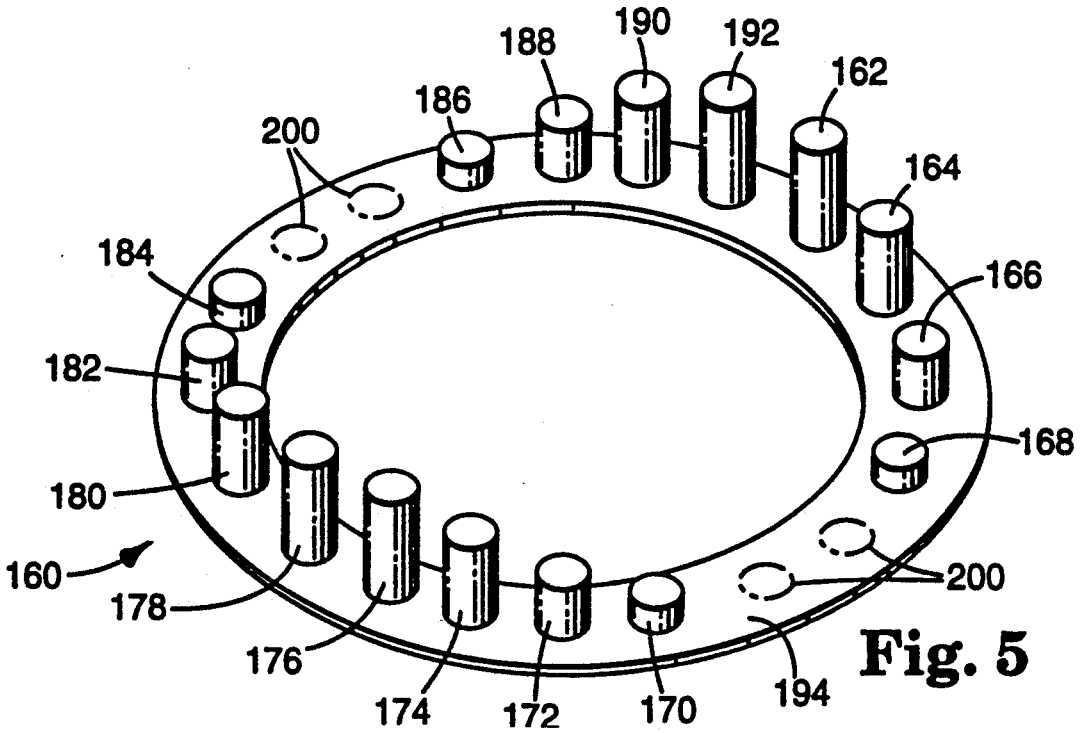
FIG. 5 is a perspective view of a spacer ring according to the present invention.

In the particular embodiment illustrated in FIG. 5, the pin members are arranged in two series, each series having pin members of increasing length in a ramp-like arrangement to a maximum length (e.g. 170, 172, 174, and 176), and then of decreasing length in a similar ramp-like arrangement to a minimum length (e.g. 178, 180, 182, and 184). No pin members are present at locations 200 (shown in ghost lines). This arrangement is believed to be preferable because the spacer rings position four peening flaps at each of five locations with respect to the peripheral surface of the hub.

A second manner of describing the spacer of the present invention is with reference to the fluctuating lengths of the pin members. The lengths of the pin members generally fluctuates around the periphery of the spacer ring, in contrast to the spacer rings of the prior art, which included only pin members of a single length. The pin members may fluctuate in any desired pattern, including that shown in FIG. 5 (discussed above), or FIGS. 7 and 8 (discussed below).

Figure 4:
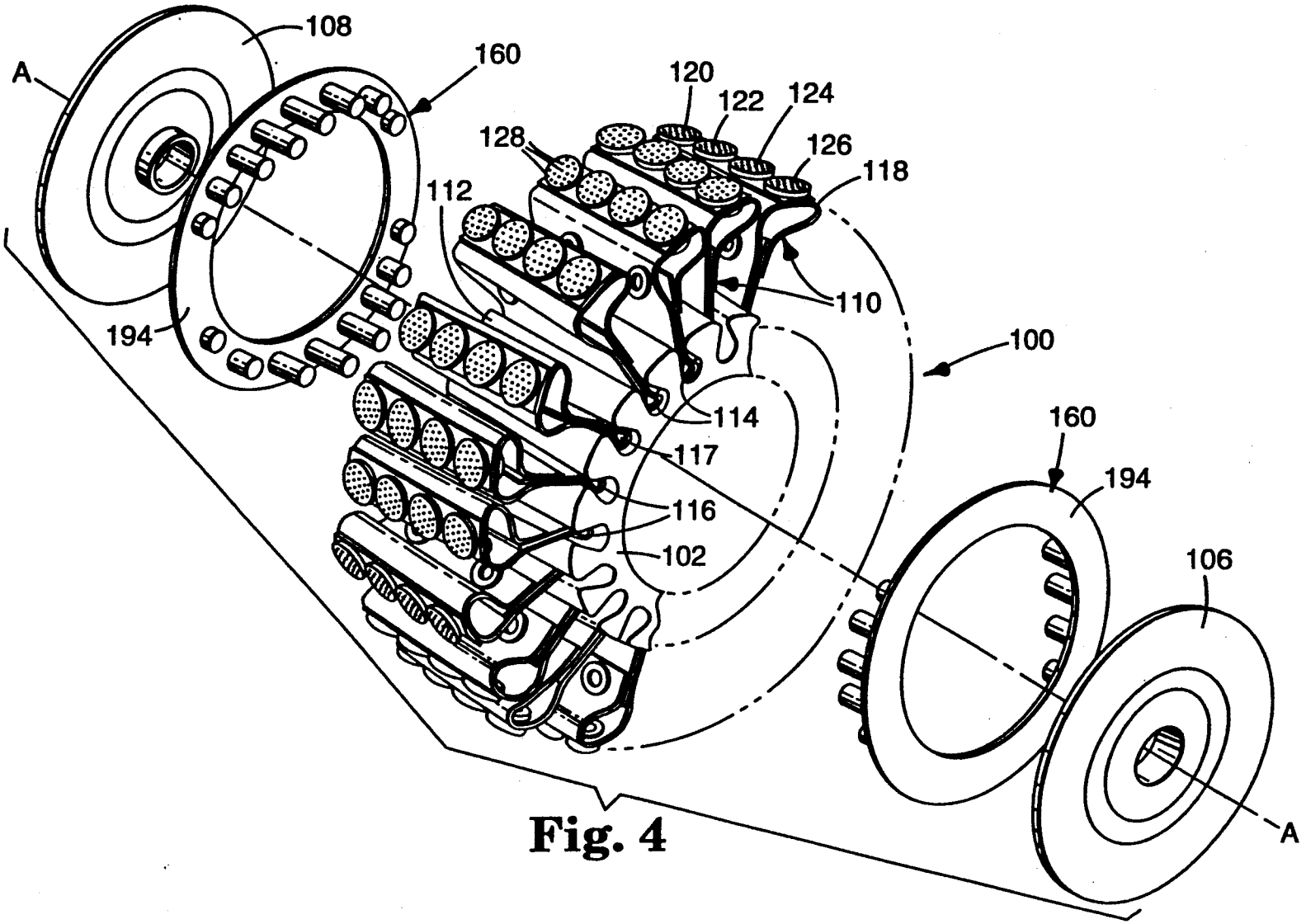
FIG. 4 is an exploded view of a rotary peening apparatus including two opposed spacers according to the present invention.

In use, two identical spacer rings are typically provided for each rotary peening apparatus, and one is rotated about axis A—A with respect to the other such that the two spacer rings cooperatively position each peening flap with respect to the two hub ends. With reference to FIG. 4, for example, a shorter pin member of one spacer ring typically corresponds to a longer pin member of the spacer ring on the opposite side of the hub, such that the peening flap is offset toward the first spacer ring. Within each flap slot, the total length of the pin members plus the peening flaps within that slot is typically equal to the width of the peripheral face of the hub. Thus, if the hub has a peripheral face width of 26.7 cm (10.5 in) and each peening flap is 5.08 cm (2 in) wide, the total length of the peening flaps is 25.4 cm (10 in). Thus, the total length of the pin members within each flap slot typically equals 1.27 cm (0.5 in) (e.g. a 0.635 cm (0.25 in) pin member on each spacer ring, or a 0.32 cm (0.125 in) pin member on one spacer ring and 0.95 cm (0.375 in) pin member on the other spacer ring, or no pin member on one spacer ring and a 1.27 cm (0.5 in) pin member on the other spacer ring). There are numerous combinations of hub width, peening flap width, and pin member length, and the foregoing examples are merely illustrative.

It is believed that certain beneficial results obtain from the design of the spacer ring described above. Most importantly, by offsetting the peening flaps using spacer rings having pin members of at least two different lengths, the rotary peening apparatus tends to produce a more uniform surface finish than rotary peening apparatuses of the prior art. It is believed that the spacer ring of the present invention reduces the need to make multiple passes over a surface. That is, coatings, latents, residuals, and other undersirable characteristics can be removed without making multiple passes over the surface with the peening apparatus. Another feature of the spacer ring illustrated in FIG. 5 is that it reduces the tendency of the rotary peening apparatus to "walk," or move transversely while the apparatus is in operation. Walking is undesirable because the apparatus does not abrade a straight section of the surface, and multiple passes may be required to peen the surface adequately.

The operation of a rotary peening apparatus including the spacer ring of the present invention will be illustrated with reference to the following Examples.

In each Example, a conventional rotary peening apparatus was provided as follows. The peening apparatus included a hub having an outer diameter of 10.2 cm (4 in), and a cylindrical peripheral surface having a width of 26.7 cm (10.5 in) and having twenty flap slots evenly spaced about the peripheral surface of the hub. Five peening flaps measuring 5.1 cm (2 in) wide were inserted into each of the flap slots. The difference of 1.27 cm (0.5 in) between the width of the peripheral surface (26.7 cm (10.5 in)) and the total width of the five flaps (25.4 cm (10 in) was provided to enable two opposed spacer rings to offset the flaps as desired. The three Examples described below relate to the surface finish produced by rotary peening apparatuses having different types of spacer rings.

Each of the one hundred peening flaps (20 flap slots×5 flaps per slot) included four peening rivets mounted on a distal end of the peening flap. Each peening rivet measured approximately 1.27 cm (0.5 in) in diameter, and the peening rivets were spaced at approximately 1.27 cm (0.5 in) on center across the width of the peening flap. The peening rivets were constructed of tungsten carbide shot brazed to a hardened rivet. Peening flaps of this type are available from the Minnesota Mining and Manufacturing Company of St. Paul, Minn., under the designation Heavy Duty Roto Peen Type D.

Rotary peening apparatuses of the type used in the present Examples are self-propelled, adjustable height, and are available from the Equipment Development Company, Inc. of Frederick, Md. under model no. CPU-10-3. This rotary peening apparatus includes an 18 horsepower engine that is adapted to rotatively drive the hub assembly upward, (known as "upcutting") meaning that the peening rivets are being driven such that the forces imparted by the peening rivets against the surface oppose the forward motion of the peening apparatus.

EXAMPLE ONE

Figure 3:
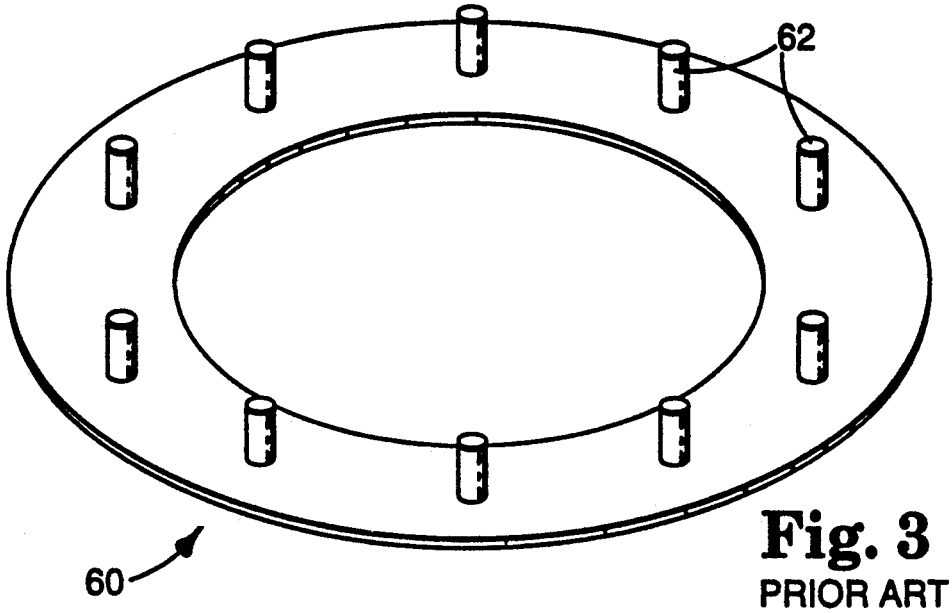
Fig. 3 PRIOR ART
FIG. 3 is a perspective view a spacer ring according to the prior art.

For Example One, two spacer rings according to the prior art were provided for use with the peening apparatus described above. Each spacer ring was similar in design to that shown in FIG. 3, wherein 1.27 cm (0.5 in) pin members were arranged to correspond t alternate flap slots around the periphery of the hub. When the spacer rings were applied to the hub, the pin members of one spacer ring corresponded to an open space on the opposed spacer ring, such that each row of flaps was offset toward either one hub end or the other hub end. Because the length of each pin member was equal to the distance between adjacent peening rivets, these spacer rings resulted in the peening rivets being circumferentially aligned with the corresponding peening rivets on each of the other peening flaps, except for the outermost peening rivets on each side.

EXAMPLE TWO

In Example Two, a hub having a peripheral surface measuring 26 cm (10.25 in) was used instead of the slightly wider hub described previously. The difference in hub width is not considered to have a significant impact on the test results, and was done to accommodate spacer rings having 0.64 cm (0.25 in) pin members rather than the 1.27 cm (0.5 in) pin members of Example One. Two spacer rings were provided according to the prior art, and were again similar to that shown in FIG. 3 except that each pin member measured 0.64 cm (0.25 in) in length. The spacer rings were applied to the hub in the same manner as in Example One, but because the length of the pin members was only one-half of the distance between adjacent peening rivets, the peening rivets of one row of flaps were aligned with the peening rivets of alternate rows of flaps around the circumference of the hub.

EXAMPLE THREE

In Example Three, a hub having a peripheral surface measuring 26.7 cm (10.5 in) was again used, as in Example One. Two spacer rings were provided in accordance with the present invention, as shown in FIG. 5. The spacer rings included pin members attached to and projecting from a base member, and having the following lengths. The reference numbers correspond to those shown in FIG. 5.

| Pin Member | Length |
|---|---|
| 168, 170, 184, 186 | 0.32 cm (0.125 in) |
| 166, 172, 182, 188 | 0.64 cm (0.25 in) |
| 164, 174, 180, 190 | 0.95 cm (0.375 in) |
| 162, 176, 178, 192 | 1.27 cm (0.50 in) |

No pin members were provided at locations 200, as shown in FIG. 5. The pin members increase in length by 0.32 cm (0.125 in) increments, and because the width of the peripheral surface of the hub was 1.27 cm (0.5 in) greater than the width of the peening flaps themselves, four different pin lengths resulted in the positioning of the peening flaps at five locations across the peripheral face of the hub. One location corresponds to the area of the spacer ring where no pin was provided.

One spacer ring was provided on each side of the hub, and one spacer ring was rotated 90° about axis A—A with respect to the other to enable cooperative positioning of the peening flaps as previously described. Because the spacer rings were rotated 90° with respect to each other, the total length of the pin members within flap slot was equal to 1.27 cm (0.5 in) (e.g. 0.32 cm+0.95 cm (0.125 in+0.375 in)) to maintain each peening flap within position.

The testing procedure was as follows. The rotary peening apparatus was rotated at a speed of approximately 1800 revolutions per minute, and the peening rivets were brought into contact with a polyurethane coated concrete surface. The peening apparatus traversed the surface at approximately 0.05 m/s (0.16 ft/sec), and after the surface was dusted, the surface characteristics were measured.

Results

Variations in the testing procedures outlined above will tend to produce different data, and thus the illustrated test results are intended solely to be illuminative rather than predictive. The surface characteristics produced by the test apparatuses described in Examples One, Two, and Three were measured using a profilometer to obtain the surface profiles shown in FIGS. 6A, 6B, and 6C. The profilometer was a model no. S6P available from the Mahr Perthen Corp. of Germany, and a BFRW750E ball probe tip was used to traverse the surface of the concrete to obtain the illustrated profiles.

Figure 6A:
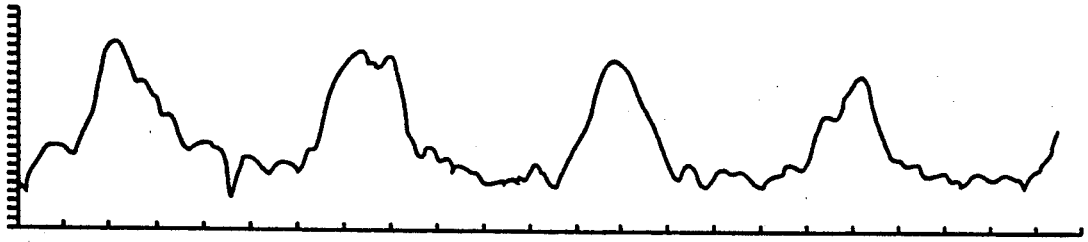
FIGS. 6A, 6B, and 6C are comparative traces of surface profiles using rotary peening apparatuses having three different types of spacer rings.
Figure 6B:
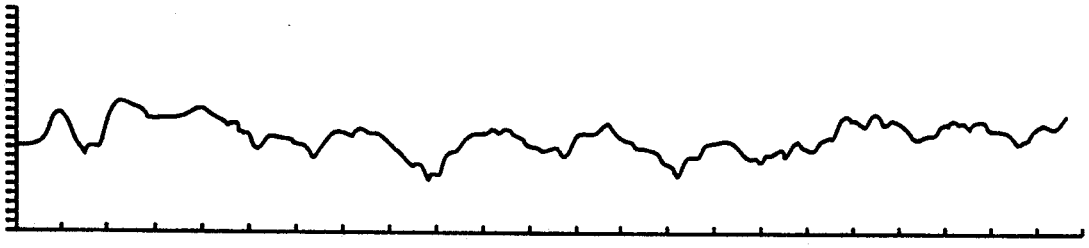
Figure 6C:
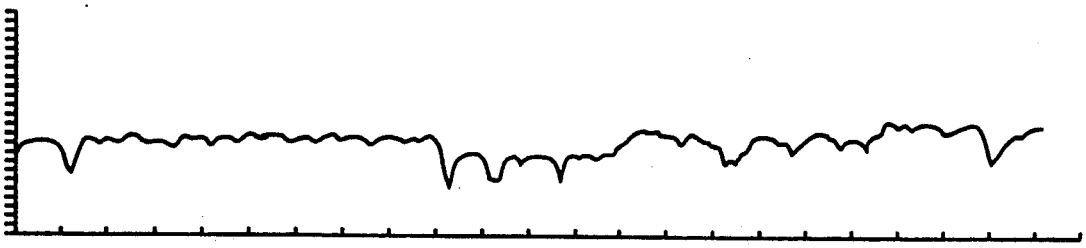

The test results displayed in FIGS. 6A, 6B, and 6C illustrate the different surface finishes produced by a rotary peening apparatus wherein each peening rivet is circumferentially aligned with the peening rivets in each adjacent row of flaps (FIG. 6A), wherein each peening rivet is circumferentially aligned with the peening rivets in alternate rows of flaps (FIG. 6B), and wherein the peening flaps are spaced at at least two locations inward of the hub ends in accordance with the present invention (FIG. 6C). Because concrete is a heterogeneous material, and may comprise widely varying surface levels and amounts of sand, gravel, and rocks even within a small area, the profilometer traces are not uniform over the width of the section tested. Nonetheless, a comparison of FIGS. 6A, 6B, and 6C shows the comparatively uniform surface finish produced by the rotary peening apparatus using the spacer rings of the present invention when compared to those of the prior art.

Figure 7:
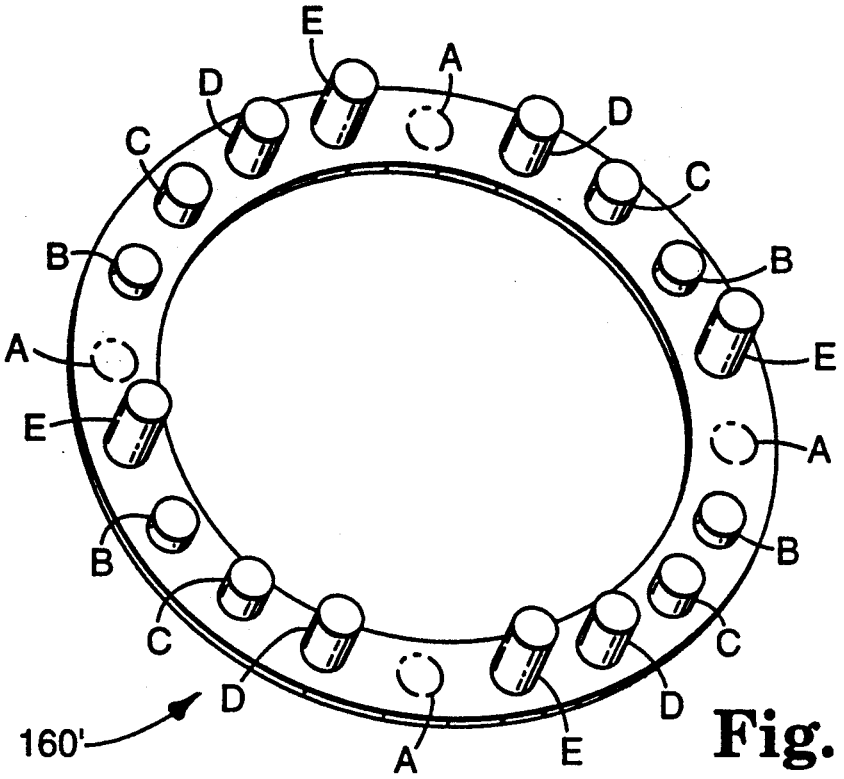
FIG. 7 is a second embodiment of the spacer ring of the present invention.
Figure 8:
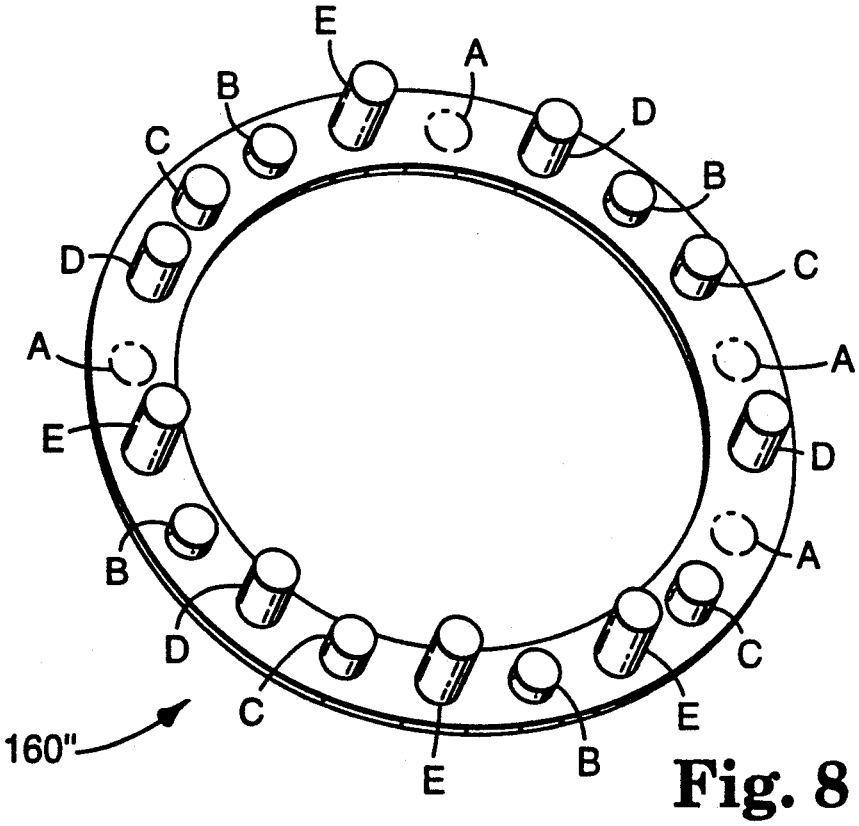
FIG. 8 is a third embodiment of the spacer ring of the present invention.

FIGS. 7 and 8 illustrate two alternate embodiments of the spacer ring of the present invention. Each includes a plurality of pin members attached to and projecting from a base member, and each is adapted to position the peening flaps of a rotary peening apparatus at at least two locations inward of one of the hub ends of the hub of the apparatus. In FIGS. 7 and 8, letter "A38 indicates a location having no pin member, letter "B" indicates a pin member having a height of 0.3175 cm (0.125 in), letter "C" indicates a pin member having a height of 0.635 cm (0.25 in), letter "D" indicates a pin member having a height of 0.9525 cm (0.375 in), and letter "E" indicates a pin member having a height of 1.27 cm (0.5 in). Other pin member heights could instead be selected, if desired. Specifically, FIG. 7 illustrates a spacer ring 160, wherein no pin members of the same height are located immediately adjacent each other, in contrast to the embodiment shown in FIG. 5. Such an arrangement may reduce the tendency for the rotary peening apparatus to walk during operation of the apparatus. The spacer ring 160" shown in FIG. 8 includes yet another arrangement of pin members, wherein the pin members of different lengths are distributed in a more random pattern than the spacer rings previously described.

The present invention is broadly disclosed as means for spacing the peening flaps from the hub ends of the hub of the rotary peening apparatus. Although the spacer rings 160, 160', and 160", illustrated in FIGS. 5, 7, and 8 respectively are thought to have utility in this regard, other embodiments are contemplated, and could comprise, for example, set screws, interference fit between peening flap and the flap slots, machining of the flap retainer to enable spacing, individual pin members, and the like. Moreover, although the present invention has been discussed primarily in the context of a rotary peening apparatus, it is believed that the spacing means of the invention may have broad applicability to rotary apparatuses that include members adapted for point abrasive contact.

The present invention has now been described with reference to several embodiments thereof. It will be apparent to those skilled in the art that many changes can be made in the embodiments described without departing from the scope of the invention. For example, the spacer of the present invention may be constructed of any suitable material, in any suitable shape, with any suitable number of pin members. The series of pin members may increase in length at constant or at variable intervals. Thus, the scope of the present invention should not be limited to the structures described herein, but only by structures described by the language of the claims and the equivalents of those structures.

We claim:

1. A spacer ring for a rotary peening apparatus including a hub having a generally cylindrical peripheral surface comprising means for releasably retaining a retaining end of each of a plurality of peening flaps, the peripheral surface bounded by opposed hub ends, the spacer comprising:

(a) a base member; and (b) a series of circumferentially spaced pin members of at least two different lengths attached to and projecting from said base member, said pin members adapted for cooperative engagement with said retaining means to position said peening flaps with respect to the hub ends of the hub.

2. The spacing apparatus of claim 1, wherein said base member is circular, and said pin members are arranged about the periphery of said base member.

3. The spacing apparatus of claim 1, wherein said pin members include, in order, a plurality of pin members of increasing length, at least one pin member having a maximum length, and a plurality of pin members of decreasing length.

4. The spacing apparatus of claim 1, wherein said apparatus includes two opposed series of pin members each including, in order, pin members of increasing length, at least one pin member having a maximum length, and pin members of decreasing length.

5. The spacer of claim 4, wherein each of said series of pin members includes, in order, three pin members of increasing length, two pin members having a maximum length, and three pin members of decreasing length.

6. A rotary peening apparatus, comprising:

a) a hub adapted for rotation about a central axis, and including a generally cylindrical peripheral surface bounded by opposed hub ends, said hub comprising means for releasably retaining a retaining end of each of a plurality of peening flaps;

b) a plurality of peening flaps each having peening rivets affixed to a distal end thereof and retaining ends adapted for cooperative engagement with said retaining means to present said peening rivets for contact with a surface; and c) means for spacing at least one peening flap at a first positive distance inward of one of said hub ends, and means for spacing at least one other peening flap at a second positive distance inward of said one of said hub ends, to offset said peening flaps with respect to said one of said hub ends.

7. The apparatus of claim 6, wherein said spacing means comprises a base member and a series of circumferentially spaced pin members attached to and projecting from said base member, said series including at least two pin members of different lengths relative to said base member.

8. The apparatus of claim 7, wherein said series includes, in order, a plurality of pin members of increasing length, at least one pin member having a maximum length, and a plurality of pin members of decreasing length.

9. The apparatus of claim 7, wherein said spacer includes two opposed series of pin members each including, in order, pin members of increasing length, at least one pin member having a maximum length, and pin members of decreasing length.

10. A spacer for a rotary abrading apparatus having a plurality of abrading members adapted for point abrasive contact with a surface, the spacer including a plurality of pin members of at least two different lengths adapted to offset the abrading members with respect to each other to enable the apparatus to impart a desired surface finish to the surface.

11. The spacer of claim 10, wherein the apparatus is a rotary peening apparatus, and the abrading members are peening flaps each comprising a plurality of peening rivets.

12. The spacer of claim 10, wherein the spacer comprises a ring-shaped base member, and said pin members are attached to and project from the base member.

13. The spacer of claim 12, wherein the offset provided by the pin members fluctuates between adjacent pin members.

14. A method of positioning peening flaps of a rotary abrading apparatus to enable the apparatus to impart a desired surface finish to a workpiece, the apparatus having a hub and a generally cylindrical peripheral surface comprising a retainer for retaining an end of each of a plurality of abrading members, the peripheral surface bounded by opposed hub ends, the method comprising the steps of:

(a) spacing the abrading members at at least two locations inward of one of the hub ends; and (b) retaining the abrading members in said locations.

15. The method of claim 14, wherein the apparatus is a rotary peening apparatus, and the abrading members are peening flaps each comprising a plurality of peening rivets.

16. The method of claim 14, wherein the step of spacing the peening flaps at at least two locations inward of one of the hub ends comprises:

(i) providing two opposed spacers each having a base member and a series of circumferentially spaced pin members attached to and projecting from said base member, said series including at least two pin members of different lengths relative to said base member, and (ii) retaining the spacers against opposite sides of the hub, with the pin members adapted to cooperate with the peening flaps to position the peening flaps at at least two locations inward of one of the hub ends of the hub.

* * * * *

UNITED STATES PATENT AND TRADEMARK OFFICE

CERTIFICATE OF CORRECTION

PATENT NO. : 5,284,039

DATED : February 8, 1994

INVENTOR(S) : Donald R. Torgerson

It is certified that error appears in the above-indentified patent and that said Letters Patent is hereby corrected as shown below:

Col. 7, line 10, "t" should read --to--.

Col. 8, line 56, ""A38" should read --"A"--.

Col. 8, line 65, "160," should read --160'--.

Signed and Sealed this

Twenty-seventh Day of September, 1994

Bruce Lehman

*Attest:*

BRUCE LEHMAN

*Attesting Officer*

*Commissioner of Patents and Trademarks*